United States Patent [19]

Matsuda

[11] 4,449,614

[45] May 22, 1984

[54] LIFT DEVICE

[75] Inventor: Minoru Matsuda, Hamura, Japan

[73] Assignee: Nissan Motor Company, Limited, Japan

[21] Appl. No.: 326,117

[22] Filed: Nov. 30, 1981

[30] Foreign Application Priority Data

Nov. 28, 1980 [JP] Japan ..... 55-167790

[51] Int. Cl.[3] ..... B66B 9/20

[52] U.S. Cl. ..... 187/9 R; 414/629

[58] Field of Search ..... 187/9 R, 9 E; 414/628, 414/629, 630, 631, 785; 91/167 R, 168, 170 R, 189 R

[56] References Cited

U.S. PATENT DOCUMENTS

| | | | |
|---|---|---|---|
| 2,399,632 | 5/1946 | Guerin | 187/9 E |
| 2,618,360 | 11/1952 | MacDonald | 187/9 E |
| 2,883,003 | 4/1959 | Arnot | 187/9 E |
| 4,356,893 | 11/1982 | Johannson | 187/9 E |

FOREIGN PATENT DOCUMENTS

| | | |
|---|---|---|
| 969652 | 9/1964 | United Kingdom . |
| 1250630 | 11/1968 | United Kingdom . |
| 2058012 | 4/1981 | United Kingdom . |

*Primary Examiner*—Joseph J. Rolla
*Assistant Examiner*—Kenneth Noland
*Attorney, Agent, or Firm*—Lowe, King, Price & Becker

[57] ABSTRACT

A lift device for a load transporter such as a fork-lift vehicle, comprises a load carrier for holding a load, a pair of chains, one end of each of which is connected to the load carrier, a pair of gears engaging the chains, a pair of outer masts secured on a base plate, a pair of inner masts capable of sliding along the outer masts and on which the load carrier is slidably mounted, a pair of first cylinders, each connected to a gear bracket rotating supporting one of the gears a first cylinder rod, a pair of second cylinders, each connected to the free end of a chain via a second cylinder rod, and means for actuating the first and second cylinders by fluid pressure.

3 Claims, 7 Drawing Figures

LIFT DEVICE

BACKGROUND OF THE INVENTION

1. Field of the Invention

The present invention relates generally to a lift device for a load transporter and more particularly to an improvement in a lift mechanism of a fork-lift which is actuated by a plurality of hydraulic cylinders.

2. Description of the Prior Art

There has been generally used a fork-lift vehicle as a load transporter capable of lifting loads. In the typical prior art lift device of the fork-lift vehicle, a pair of hydraulic cylinders drives a pair of inner masts to slide along a pair of outer masts so that a load carrier can be lifted. However, when a load is transported under conditions in which height clearance is limited, such as in a factory, a storage building, or and a container, it is sometimes necessary to lift the load without raising the masts. That is, if the maximum height to which the load carrier can be lifted without raising the masts (herein after, referred to as "free-lift height") is low, the load can not be transported by the fork-lift vehicle. Accordingly, in order to increase the free-lift height, the inner masts can be arranged to be lower than the outer masts. But, such an arrangement decreases the minimum road clearance between the bottom end of the inner masts and the road so that the fork-lift vehicle so arranged is not suitable for practical use.

BRIEF SUMMARY OF THE INVENTION

With these problems in mind, therefore, it is an object of the present invention to provide an improved lift device which can lift a load without changing the position of the masts.

Another object of the present invention is to provide an improved lift device which has a sufficiently high road clearance to avoid interference between the lift device and the ground.

Another object of the present invention is to provide an improved lift device which can be mounted on a fork-lift vehicle designed for wide field of operator vision.

To achieve the above-mentioned objects, a lift device according to the present invention comprises a load carrier for holding a load, a pair of chains, one end of each of which is connected to the load carrier, a pair of gears engaging the chains, a pair of outer masts secured on a base plate, a pair of inner masts capable of sliding along the outer masts and on which the load carrier is slidably mounted, a pair of first cylinders, each connected to a gear bracket rotatably supporting one of the gears via first cylinder rod, a pair of second cylinders, each connected to the free end of one of the chains via a second cylinder rod, and means for actuating the first and second cylinders by fluid pressure.

BRIEF DESCRIPTION OF THE DRAWINGS

The features and advantages of the lift device according to the present invention will be more clearly appreciated from the following description taken in conjunction with the accompanying drawings in which like reference numerals designate corresponding elements, and in which.

DETAILED DESCRIPTION OF THE PREFERRED EMBODIMENT

Figure 1:
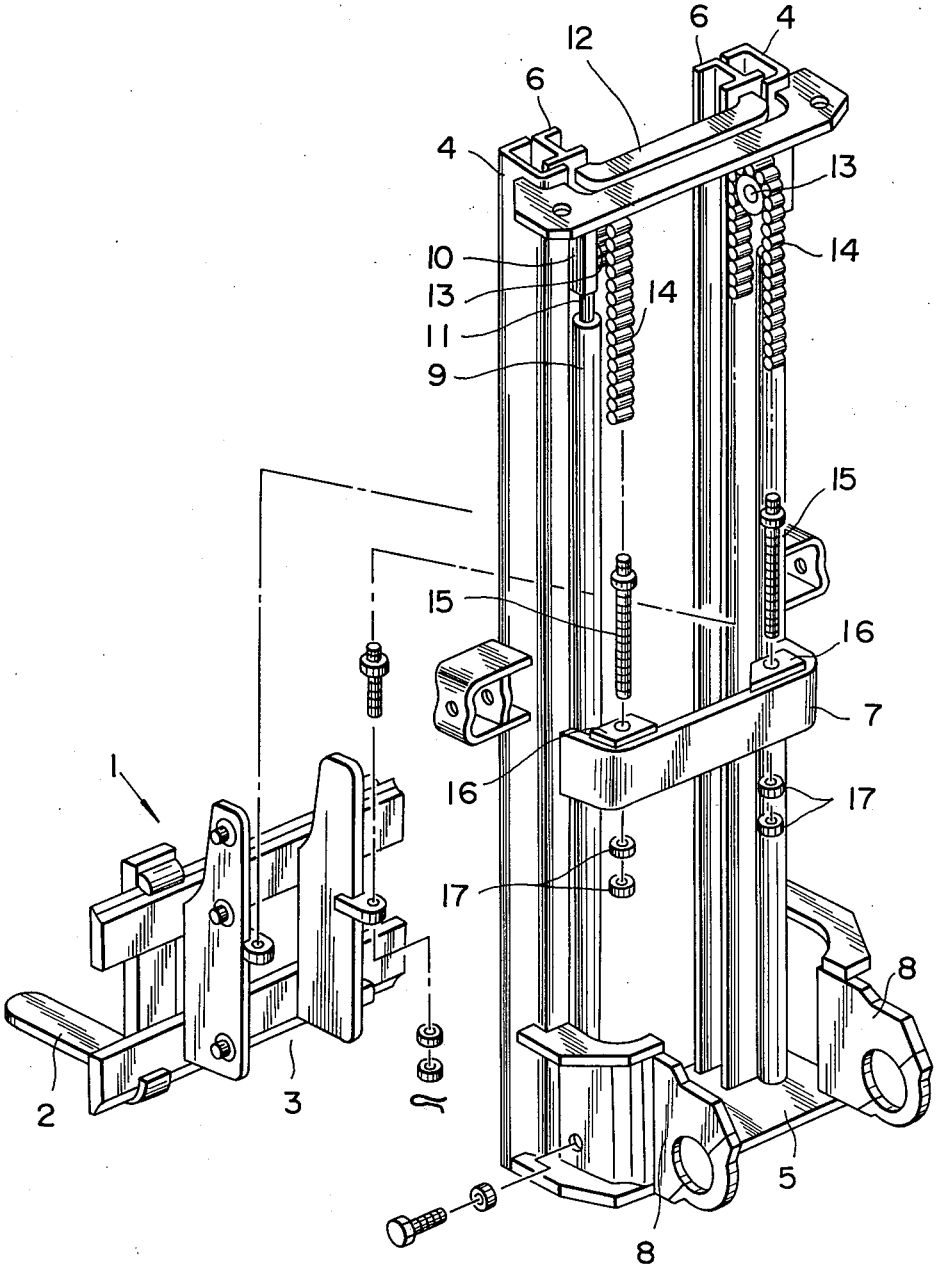
FIG.1 PRIOR ART
FIG. 1 is an exploded perspective view of a prior art lift device of a fork-lift.

To facilitate understanding the present invention, a brief reference will be made to a prior art fork-lift. Referring to FIG. 1, there is shown an exploded perspective view of one typical prior art lift device such as, for example, a fork-lift vehicle to lift and transport loads. The reference numeral 1 denotes a load carrier, which comprises a fork 2 secured to a lift member 3. The loads to be transported are generally hung by or mounted on the fork 2. The reference numeral 4 denotes a pair of outer masts 4 vertically secured to a base plate 5. An inner mast 6 is so arranged in the each outer mast 4 as to vertically move along the outer mast 4. The load carrier 1 is slidably mounted on a pair of the inner masts 6 via roller members, similar to those shown as 40 in FIG. 3. A cross member 7 is secured to both of the outer masts 4 as a reinforcement. The lower ends of the outer masts 4 are each provided with a bracket 8 for connection to, for example, a fork-lift vehicle body not shown. A hydraulic cylinder 9 is located behind each pair of outer mast 4 and inner mast 6. Each respective hydraulic cylinder 9 is connected to a gear-bracket 10 via a cylinder rod 11. Each gear-bracket 10 is in turn secured to an inner cross member 12 fixedly connected between the inner masts 6. A gear 13 is rotatably supported by each gear-bracket 10. The gear 13 engages a chain 14, one end of which is connected to the lift member 3 and the other end of which is connected to the head of a bolt 15. A bracket 16 formed with a hole is secured to each end of the cross member 7. The screw bolt 15 is inserted through the hole so as to be fixed to the bracket 16 by nuts 17.

Figure 6:
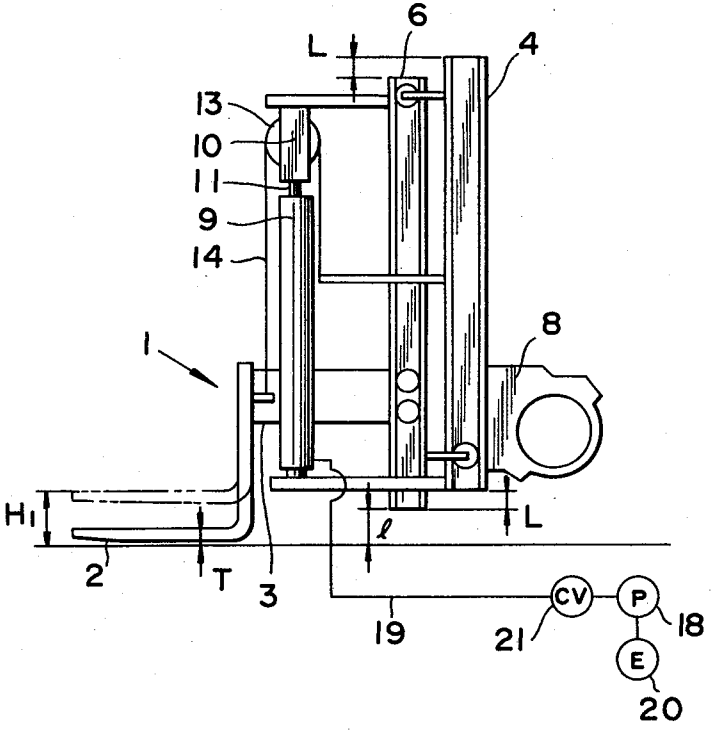
FIG.6 PRIOR ART
FIG. 6 is a schematic representation showing the free-lift height of the prior art fork-lift of FIG. 1.

FIG. 6 shows an operation mechanism of the above mentioned prior art fork-lift. The reference numeral 18 denotes a pump which supplies fluid pressure to the cylinder 9 through a fluid passage 19. The pump 18 is driven by an internal combustion engine or electric motor 20. The fluid pressure fed from the pump 18 is controlled by a control valve 21 located along the fluid passage 19.

In the conventional fork-lift described above, a lift operation is conducted as follows.

When the fluid pressure is introduced into the cylinder 9, the cylinder rod 11 is moved upwards in proportion to the pressure so that the inner mast 6, the gear-bracket 10, and the gear 13 ascend together. Accordingly, the load carrier 1 is also raised due to the movement of the chain 14. On the other hand, when the cylinder rod 11 is lowered by reducing the fluid pressure in the cylinder 9, the inner mast 6, the gear-bracket 10, and the gear 13 descend so that the load carrier 1 also moves downwards.

FIG. 6 shows also the free-lift height in the prior art fork-lift. In the figure, L represents the difference between the heights of the outer mast 4 and the inner mast 6. T represents the thickness of the fork 2. $H_1$ represents the free-lift height in the prior art fork lift. The relation among these values can be defined by the equation;

$$H_1=2L+T.$$

In general, the prior art fork-lift shows that the top end of the outer mast 4 is the highest point when the load carrier 1 is in its lower position. Thus, the free-lift height $H_1$ of the prior art fork-lift will only be about 150 mm.

Accordingly, as noted in the foregoing description, when loads are transported under conditions of limited clearance in a factory, a storage building, a container or the like, for example, when the height of an entrance or gate thereof is almost equivalent to or a little more than that of the outer mast 4, the prior-art fork-lift can not pass through the entrance or the gate with the load raised.

Alternatively, in order to increase the free-lift distance, the prior art fork-lift can be arranged in such manner that the inner mast 6 is initially positioned lower than the outer mast 4 so as to increase the difference L between the heights of the outer mast 4 and the inner mast 6. The above structure, however, reduces the minimum road-clearance l as shown in FIG. 6. Accordingly, a fork-lift vehicle having such a small road-clearance might cause some problems when the vehicle runs on an uneven floor or road.

Figures 2, 4:
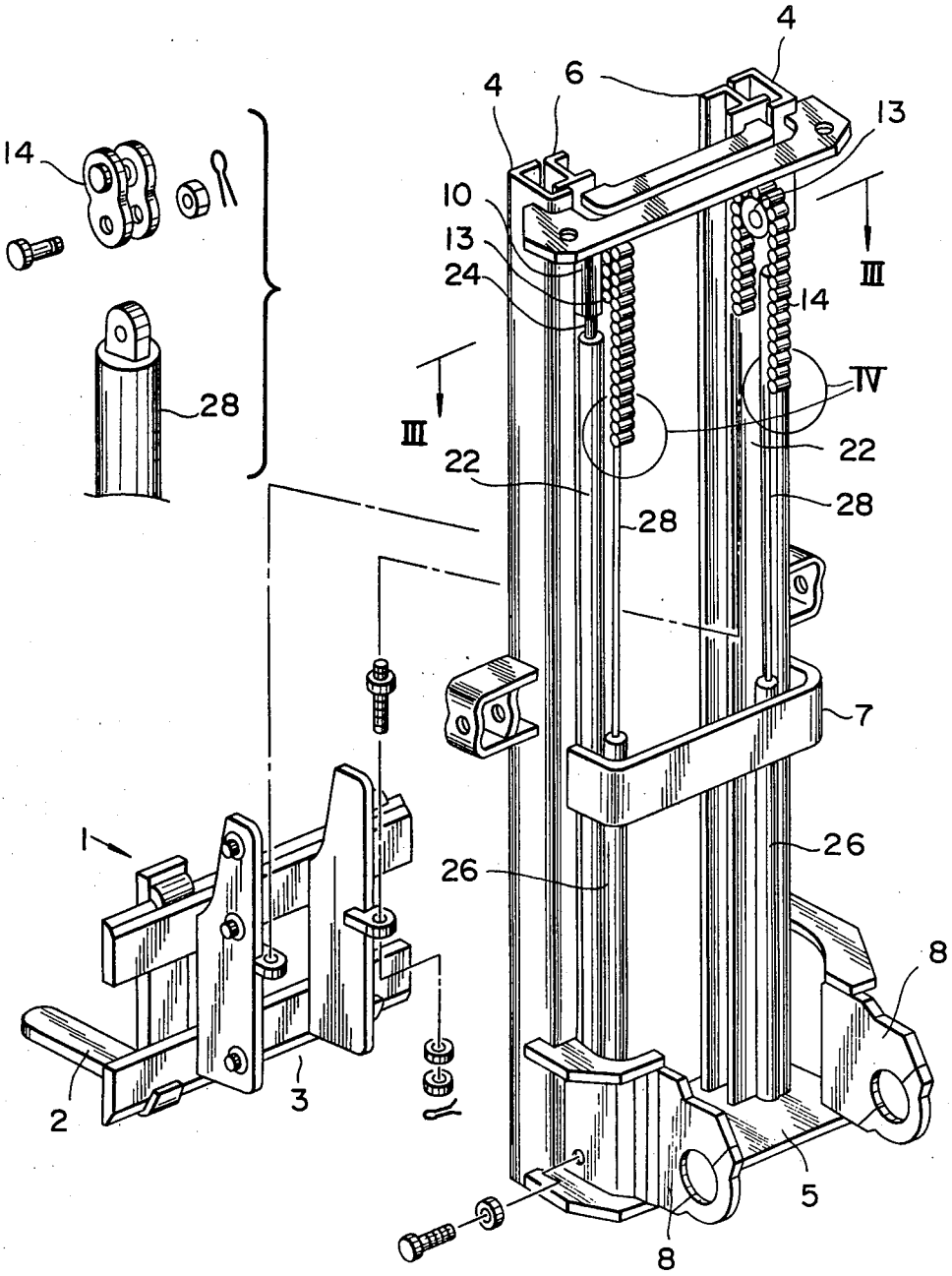
FIG. 2 is an exploded perspective view of a lift device of a fork-lift according to an embodiment of the present invention.
FIG. 4 is an enlarged exploded view of components indicated by the arrow IV in FIG. 2.

FIG. 2 is an exploded perspective view of a preferred embodiment according to the present invention. Further, FIGS. 3, 4, 5, and 7 are views showing the preferred embodiment of FIG. 2. In these figures, the same reference numerals denote the same or corresponding parts or elements shown in FIG. 1. Therefore, analogous explanations will not be repeated.

Figure 3:
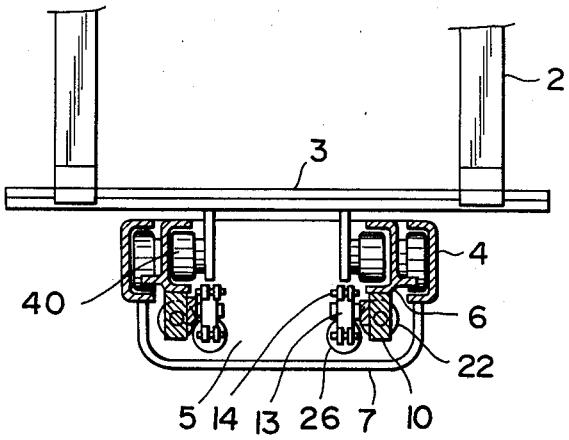
FIG. 3 is a cross-sectional view taken along the line III—III in FIG. 2.

In FIG. 2, the reference numeral 22 denotes a pair of first hydraulic cylinders such as ram-type cylinders. One of the cylinders is provided behind each outer mast 4 and is supported by the cross member 7 and the base plate 5 in the same manner as in the prior art fork-lift. Each first cylinder 22 is connected to the gear-bracket 10 via a first cylinder rod 24. The reference numeral 26 denotes a pair of second hydraulic cylinders, such as piston-type cylinders. Each second cylinder 26 is arranged parallel to the corresponding first cylinder 22 and secured thereto, for example, by welding as shown in FIG. 3, which is a cross-sectional view taken along the line III—III in FIG. 2. Each second cylinder 26 is connected to one end of a chain 14 via a second cylinder rod 28. The axes of the second cylinder 26 and its rod 28 are vertically aligned so that the force generated by the cylinder 26 is applied in the vertical direction.

FIG. 4 is an enlarged exploded view of a joint between the second cylinder rod 28 and the end of the chain 14. The other end of the chain 14 is connected to the lift member 3 in the same manner as the prior art fork-lift shown in FIG. 1.

Figure 5:
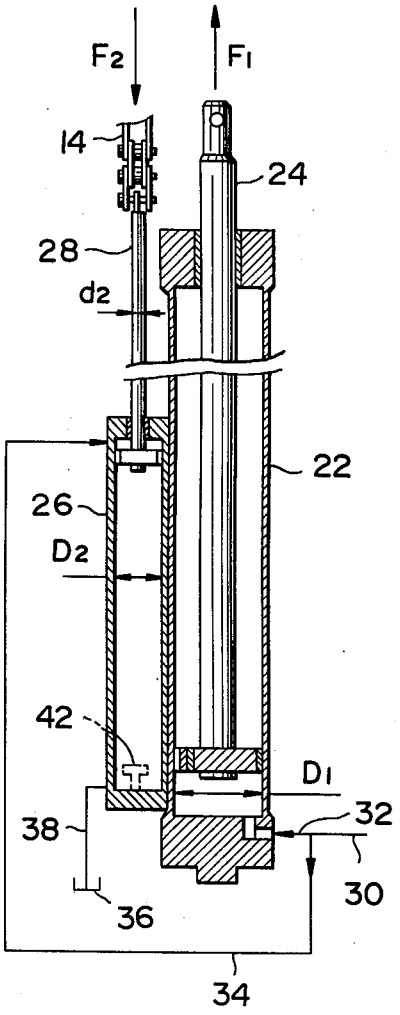
FIG. 5 is a longitudinal-sectional view of cylinder elements in FIG. 2.

FIG. 5 is a longitudinal-sectional view of the first and second cylinder elements 22 and 26. A main fluid passage 30 connected to the pump 18 branches into a first passage 32 which leads to the bottom of the first cylinder 22 and a second passage 34 which leads to the top of the second cylinder 26. Further, the bottom of the second cylinder 26 is connected to a fluid tank 36 through a third passage 38.

The operation of the first and second cylinders 22 and 26 is as follows.

Referring to FIG. 5, the force $F_1$ imparted by the first cylinder system will be actuated upwards with respect to gear 13, while the force $F_2$ from the second cylinder system will be applied downward to chain 14.

The weight of the load and carrier for each gear is $$\frac{W+C_W}{2}$$

bearing in mind that the load and carrier ($W+C_W$) is divided equally between two gears.

When this system is in equilibrium, the relation can be defined by the formulae $$F_2=\frac{W+C_W}{2}$$

and $F_1=2F_2$. Furthermore, the first cylinder 22 is subject to the weight $W_M$ of the inner mast 6 and the frictional resistance ($R_W$) of roller member 40; these factors are so large that they cannot be ignored. Thus, equilibrium is satisfied by the following equation:

$$F_1=2F_2+W_M+R_W \quad (1)$$

To actuate the second cylinder 26 prior to the first cylinder 22, the force $F_1$ should be smaller than that required for equilibrium, that is, the relation between $F_1$ and $F_2$ is defined by the following formula:

$$F_1<2F_2+W_M+R_W \quad (2)$$

The relation among the forces $F_1$ and $F_2$ and the first and second cylinders is defined by the following equations:

$$F_1=\pi/4\times D_1^2\times p \quad (3)$$
$$F_2=\pi/4\times(D_2^2-d_2^2)\times p \quad (4)$$

wherein, $D_1$ represents the inner diameter of the first cylinder 22;

$D_2$ represents the inner diameter of the second cylinder 28;

$d_2$ represents the outer diameter of the second cylinder rod 24; and p represents the pressure applied in the cylinders.

Next, the formula (2) can be rewritten by combining it with equations (3) and (4), to obtain the following:

$$\pi/4\times D_1^2\times p<2[\pi/4\times(D_2^2-d_2^2)\times p]+W_M+R_W \quad (5)$$

Thus, according to equation (5), the inner diameter of the first cylinder 22, the inner diameter of the second cylinder 26 and the outer diameter of the second cylinder rod 28 can be defined so as to actuate the second cylinder prior to the first cylinder. In practice, the dimension of any one of these cylinders may be predetermined, and then the required diameter of the other cylinder may be obtained by applying equation (5), thereby avoiding trial and error.

Figure 7:
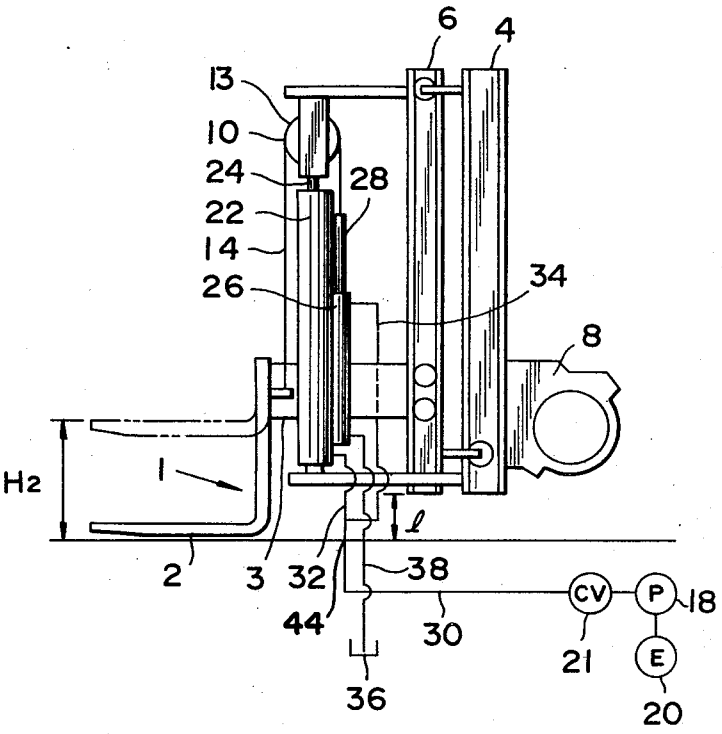
FIG. 7 is a schematic representation showing the free-lift height of the fork-lift shown in FIG. 2.

FIG. 7 shows an drive system for the embodiment according to the present invention. The pump 18 is actuated by the engine 20 so as to feed fluid pressure to the main fluid passage 30 through the control valve 21 in the same manner as the prior art shown in FIG. 1. The fluid pressure is introduced into the second cylinder 26 through the second passage 34 so that the second cylinder rod 28 is moved downwards by the fluid pressure. Simultaneously, the chain 14 connected to the rod 28 is pulled downwards in response to the movement of the rod 28. Thus, the load carrier 1 connected to the other end of the chain 14 is raised. The carrier 1 stops after moving a distance which corresponds to the stroke of the second cylinder 26, and then fluid pressure begins to flow into the first cylinder 22 through the first passage 32. The first cylinder rod 24 is raised by the fluid pressure introduced into the cylinder 22 so that the gear-bracket 10, the gear 13, and the inner mast 6 are also raised. Accordingly, the carrier 1 is also raised in response to this movement.

Conversely, the reverse of the above proceeding operation can lower the carrier 1 to the starting position.

Furthermore, when the lift actuation changes from the first cylinder 22 to the second cylinder 26, the lifting speed of the carrier 1 remains almost constant.

In this embodiment, the free-lift height $H_2$ shown in FIG. 7 can be defined by the equation:

$$H_2=S+T$$

wherein, S represents the stroke of the second cylinder 26; and T represents the thickness of the fork 2.

Since the thickness of the fork 2 is relatively small and constant, the free-lift height $H_2$ depends on the value of the stroke of the second cylinder 26. Accordingly, a large free-lift height can be obtained by selecting a second cylinder with a long stroke. For example, when the conventional fork-lift having a normal height of 2 m and a maximum lifted height of 3 m was modified in accordance with this embodiment, the maximum free-lift height of about 700 mm could be obtained.

Further, the second cylinder 26 may include an adjustable spacer 42, indicated by a phantom line in FIG. 5, on the bottom of the cylinder 26. The stroke of the cylinder 26 can be changed by adjusting the adjustable spacer 42 so that the free-lift height can be also changed as required.

In this embodiment, as mentioned above, the free-lift height can be increased without changing the height of the outer mast 4. In addition, as is seen in FIG. 7, the difference between the heights of the outer mast 4 and the inner mast 6, corresponding to L in FIG. 6, can be reduced or eliminated so that the road clearance l can be increased significantly. Furthermore, when this embodiment is applied to a certain type of fork-lift in which masts are so arranged as to provide a wide field of vision from the operator seat (not shown), the carrier will not interfere at all with the operator's field of view even though the maximum free-lift height is increased.

Additionally, since the second cylinders 26 are added to the first cylinders 22 so that the masts are reinforced by the second cylinders 26, the weight of the other structural members, such as the cross member 7, can be reduced.

Although this embodiment shows an example in which the lift mechanism according to the present invention is applied to one type of fork-lift, in particular to the wide-view mast arrangement as described above, the present invention is not limited to this example alone. For example, the present invention may comprise additional cylinders, or an arrangement of single first and second cylinders 22 and 26.

In this embodiment, a ram-type cylinder and a piston-type cylinder are employed for the first cylinder 22 and the second cylinder 26, respectively, as mentioned above. The cylinders 22 and 26 are, however, not only limited to such combination, but, for example, the reverse combination might alternatively be employed.

The second cylinder 26 is integrally secured to the first cylinder 22 by welding. But, it may be secured to the other members such as the cross member 7 or the base plate 5, which support the first cylinder 22, by means of fastening devices such as clamps, screw and the like.

In order to actuate the lift mechanism of this embodiment, the fluid pressure fed from the pump 18 is firstly introduced into the second cylinder 26 through the second passage 34 branching from the main passage 30 so that the second cylinder rod 26 is actuated first and then the first cylinder rod 24 is actuated by the fluid pressure fed through the first passage 32 branching from the main passage 30. In addition to this arrangement, a switching valve 44 may be provided at the branch of the main passage 30 so that either of the first and second cylinders 22 and 26 can be independently actuated by changing the fluid flow direction. Accordingly, if the fork-lift is equipped with such switching valve, lifting operation can be carried out using only the first cylinder 22 in the same manner as the prior art when height is not limited, such as in an operation outdoors.

The load carrier 1 may be selected from any of several shapes, such as a single plate instead of the fork 2, in accordance with the shape, size and number of the load to be lifted.

It will be apparent that the objects heretofore enumerated as well as others have been accomplished, and that there has been provided an improved lift device of fork-lift which can change the maximum free-lift height without changing the height of the fork lift by adjusting the stroke of a second cylinder.

It will be understood by those skilled in the art that the foregoing description is in terms of preferred embodiments of the present invention wherein various changes and modifications may be made without departing from the spirit and scope of the invention, as set forth in the appended claims.

What is claimed is:

1. A lift device comprising:

a base member;

a pair of outer masts vertically secured on the base member parallel to each other;

a pair of inner masts slidably mounted in said outer masts;

a load carrier slidably mounted on said pair of inner masts;

a pair of chains, one end of each of which is connected to said load carrier;

a pair of gears for engaging with said chains;

a pair of first hydraulic cylinders having first cylinder rods connected at their free ends to brackets for said gears;

a pair of second hydraulic cylinders having second cylinder rods, the free ends of which are connected to the free ends of said chains, the inner diameters of said first and second cylinders being defined by the following formula in order to actuate said second hydraulic cylinder prior to said first hydraulic cylinder:

$$\pi/4 \times D_1^2 \times p < 2\{\pi/4 \times (D_2^2 - d_2^2) \times p\} + W_M + R_W$$

wherein $D_1$ represents the inner diameter of the first cylinder; $D_2$ represents the inner diameter of the second cylinder; $d_2$ represents the outer diameter of the second cylinder rod; $W_M$ represents the weight of the inner mast; $R_W$ represents the friction resistance between the load carrier and the inner mast; and p represents the pressure force applied to the cylinders;

and a cylinder actuating means for actuating said first cylinders and second cylinders, said cylinder actuating means containing a fluid pressure feeding source, a main fluid passage connected to said fluid pressure feeding source, a first fluid passage connected between said main fluid passage and a bottom of said first cylinder, and a second fluid passage connected between said main fluid passage and a top of second cylinder;

whereby said second cylinder rod can be moved downward before said first cylinder rod is moved upward.

2. A lift device according to claim 1, wherein said second cylinder is integrally secured to the outer surface of said first cylinder by welding.

3. A lift device according to claim 1 or 2, wherein said cylinder actuating means further comprises a switching valve which is disposed at the branch of the main passage to the first passage and the second passage so as to actuate either said first or second cylinder independently.

* * * * *